US005344179A

United States Patent [19]

Fritschi et al.

[11] Patent Number: 5,344,179

[45] Date of Patent: Sep. 6, 1994

[54] ADJUSTABLE LENGTH BINDING SYSTEM FOR SNOWBOARDS HAVING INDEPENDENTLY VARIABLE HEEL AND TOE SPANS

[75] Inventors: Andreas Fritschi, Wimmis; Christian Fritschi, Reichenbach im Kandertal, both of Switzerland

[73] Assignee: Fritschi Ag. Apparatebau, Reichenbach Im Kandertal, Switzerland

[21] Appl. No.: 980,532

[22] Filed: Nov. 23, 1992

[30] Foreign Application Priority Data

Nov. 28, 1991 [CH] Switzerland ..... 3491/91

[51] Int. Cl.[5] ..... A63C 9/00; A63C 5/03

[52] U.S. Cl. ..... 280/618; 280/633; 280/14.2

[58] Field of Search ..... 280/14.2, 617, 618, 280/607, 11.26, 633

[56] References Cited

U.S. PATENT DOCUMENTS

| | | | |
|---|---|---|---|
| 3,950,001 | 4/1976 | Weigl | 280/618 |
| 4,185,852 | 1/1980 | Himmetsberger et al. | 280/618 |
| 4,955,633 | 9/1990 | Stritzl et al. | 280/618 X |
| 4,997,199 | 3/1991 | Horn | 280/618 |
| 5,085,456 | 2/1992 | Horn | 280/618 |

FOREIGN PATENT DOCUMENTS

| | | | |
|---|---|---|---|
| 0371349 | 6/1983 | Austria . | |
| 0432588 | 6/1991 | European Pat. Off. . | |
| 2246668 | 4/1974 | Fed. Rep. of Germany . | |
| 2624389 | 6/1989 | France | 280/14.2 |
| 2626189 | 7/1989 | France | 280/14.2 |
| 0676327 | 1/1991 | Switzerland . | |

*Primary Examiner*—Margaret A. Focarino
*Assistant Examiner*—Peter C. English
*Attorney, Agent, or Firm*—Zarley, McKee, Thomte, Voorhees, & Sease

[57] ABSTRACT

A binding unit (1) for gliding boards, such as snowboards, is composed of two support plates (2) and (3) which can be independently telescoped along the longitudinal axis of a boot. Each support plate is slidingly guided along this longitudinal axis in a guide element (4 and 5, respectively). Sole-holding shackles (7 and 9) are held laterally. The support plates are form-lockingly held in a position set to the boot length by starting from a central fixing element (6).

18 Claims, 8 Drawing Sheets

FIG. 16
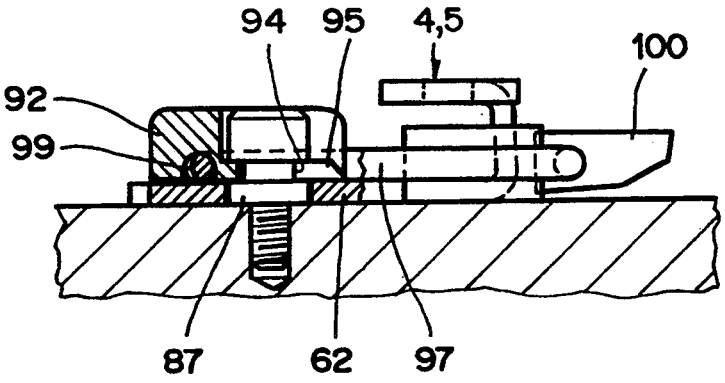
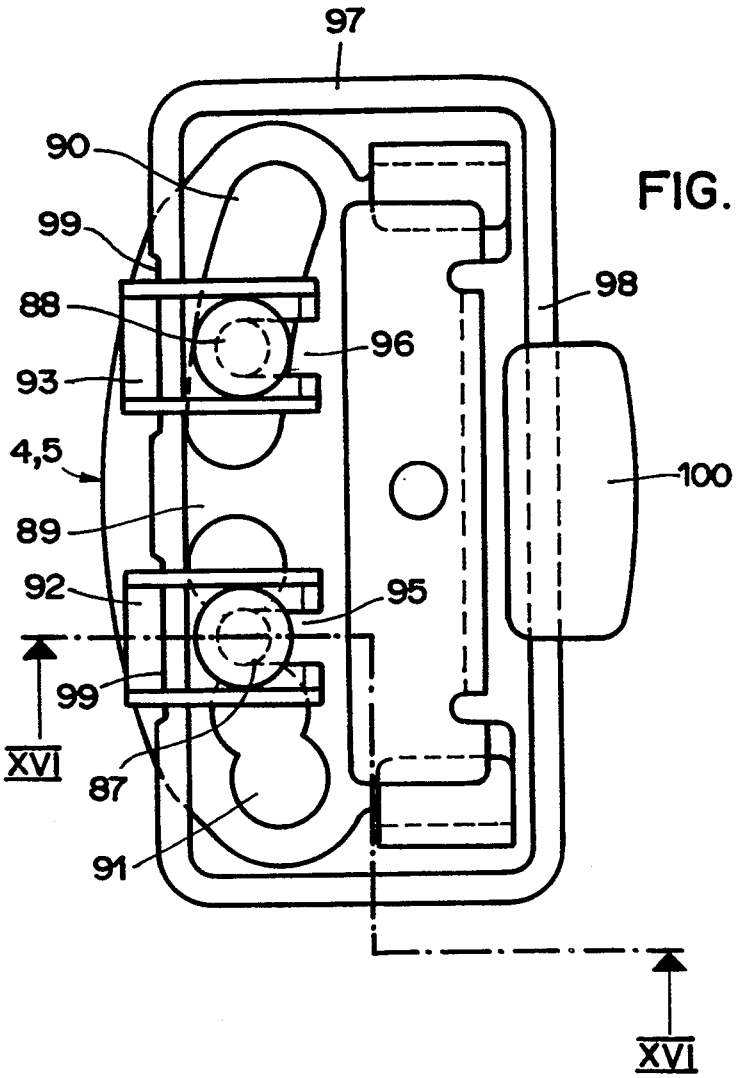
FIG. 15

ADJUSTABLE LENGTH BINDING SYSTEM FOR SNOWBOARDS HAVING INDEPENDENTLY VARIABLE HEEL AND TOE SPANS

BACKGROUND OF THE INVENTION

This invention relates to bindings, and more particularly to a binding system for a gliding board, especially a snowboard, of the type having two binding units, each serving to mount a boot on the snowboard, each binding unit being provided with, a front and a rear sole holding-down means, at least one of which is equipped with an opening device, the sole holding-down means being secured in mountings which are displaceable on plates in the longitudinal direction of the boot and fixable, and the plates being connected via a mounting to the gliding board.

Binding systems for snowboards serve the primary purpose of holding the user's boots on the snowboard. Besides that, however, binding systems must meet other requirements, viz., adaptability to various shoe sizes and adjustability of the angle of the boots to the longitudinal axis of the snowboard. Furthermore, it is customary for snowboarders to have the stronger or jumping leg assume the forward position on the snowboard. As a result, some of them have the left leg forward—this being called the "regular" position—whereas others have the right leg forward—this position being called "goofy". This means that it should be possible to switch the binding system over from the "regular" position to the "goofy" position.

Moreover, the binding system should be attached to the snowboard in such a way that the elastic deformation of the snowboard is unrestrictedly ensured in every direction during gliding. For the binding system, this means that even with clamped boots, no stiffening limiting the mobility of the snowboard must occur, for only in this way is the full running ease of the snowboard ensured.

Various binding systems for snowboards have been proposed. For example, Swiss Patent No. 677,191 discloses a binding system in which an elongated plate is held by a centrally disposed device in such a way that it can be fixed in virtually any desired swivel position. This device is made up of a base plate screwed to the snowboard and a bolt disposed in the center. A screw can be driven into the bolt, whereby the base plate can be fixed via intermediate plates to the plate screwed to the snowboard. For mounting the holding shackles for fixing the boots, means are provided which are screwed to the base plate and are displaceable longitudinally after loosening the screw connection in order to be able to set the binding to the length of the boots.

One drawback of the above binding system is that longitudinal adjustment for adapting to various boot lengths is particularly difficult. For one thing, the central screw must be unscrewed for this purpose so that the base plate can be removed in order to be able to loosen on the underside thereof the screws by which the mountings for the boots are connected to this base plate. Adjustment of the longitudinal setting cannot be carried out without an additional tool. For another thing, the length of the base plate is designed to accomodate even the largest boots. When it is adjusted for smaller boots, the front and back ends of the base plate extend past the ends of the boots. In the case of narrow snowboards, the base plate may thereby project beyond the edge of the snowboard so that these protruding ends are liable to come in contact with the underlying snow, especially in curves, which may lead to a fall. In addition, this is considered unattractive. Moreover, there are bare edges which someone may strike against or get caught on, whereby a certain risk of injury cannot be excluded.

Another such binding system is depicted in European Patent Application Publication No. 285,558. A turntable is held pivotingly via a ring and a flange secured to the snowboard by means of screws. The turntable may be fixed in each swivel position by a spring-loaded slide mounted for radial displacement in the turntable, which slide engages the teeth of the ring connected to the snowboard. The holding shackles for the boots are attached to a yoke secured to the turntable. The binding is set to the boot length by displacing the shackles along the yokes secured to the turntable. In this design, too, the yokes project beyond the front and back ends of the boots when the binding is adjusted for small boots, thus presenting a risk of getting caught in the snow or of injury.

It is an object of this invention to provide a binding system for a gliding board, especially a snowboard, which is attached in such a way that even with clamped boots, the elastic mobility of the board is not impaired in any way.

A further object of the invention is to provide such a binding system which is easily adjustable for boots of any size without requiring the use of an auxiliary tool.

Another object of the invention is to provide a binding system without parts which project beyond the ends of the boots after adjustment to the boot size.

Still another object of the invention is to provide a binding system which meets the requirements for attractiveness.

SUMMARY OF THE INVENTION

Other objects and advantages of the invention will become apparent from the following detailed description of the preferred embodiments thereof, taken in conjunction with the accompanying drawings. The binding system according to the present invention, the front and rear sole holding-down means are each affixed to a respective support plate, the two support plates are displaceable independently of one another in the longitudinal direction of the binding unit and are held in a set position by a fixing element which is connected to the snowboard and is operatively connected to the two support plates, and each of the two support plates is slidingly guided in a respective guide element which is detachably connected to the snowboard.

The two guide elements of a binding unit for fixing a boot to the snowboard, in which guide elements each of the support plates is slidingly engaged, are preferably detachably and adjustably connected to the snowboard. This detachable and adjustable connection yields the possibility of setting the longitudinal axis of the binding unit and consequently the alignment of the boot with respect to the longitudinal axis of the snowboard. This also results in the possibility of easily changing the binding system from a position intended for a user whose preferred posture is "right leg forward" to a position for another user who prefers "left leg forward," or in snowboarder jargon, to switch the binding system from the "goofy" position to the "regular" one.

A preferred design of the fastening of these guide elements to the snowboard consists in disposing fixed cylindrical pins on the snowboard, whereby the guide elements can be unplugged and replugged from the "goofy" position to the "regular" one. In the upper end of each pin there is a circular groove into which, when a guideway is mounted, it is possible to insert a clamping element which can be clamped and released by shifting a flap or a yoke. Those pins non needed for a position in which the binding system is secured on the snowboard may be protected by cap-shaped covers.

For adjusting the longitudinal alignment of a binding unit relative to the longitudinal axis of the snowboard, the guide elements in which the support plates are slidingly held are preferably provided with a slot for mounting about one of the pins and with a row of holes for the other pin. After release of the clamping element, the guideway may thereby be lifted off the pins, displaced laterally, mounted on the pins in the new position, and fixed by means of the clamping element. The row of holes and the slot are so disposed that the guide elements are always the same distance from the central fixing element.

The central fixing element preferably consists of a cylindrical journal integral with the snowboard and provided with a circular groove in the upper portion of its circumference. At the ends of the support plates nearest the central cylindrical journal there are respective extensions, each of which runs past one side of the cylindrical journal, engaging the groove by its inner long edge and being guided thereby. In a preferred embodiment, these extensions each include a longitudinal slot having a tooth-shaped profile formed on the sides thereof facing the central cylindrical journal. The displaceable support plates of a binding unit are secured form-lockingly by a swiveling lever which is fixed on the central journal when the binding unit is mounted on the snowboard. This swiveling lever has two arms with angled edges, each of which engages a slot in the extensions of the two symmetrically disposed support plates. The two edges are profiled in a manner matching the tooth-shaped profile of the longitudinal slot of the extensions. When swung closed, the profiles of the edges mesh with the tooth-shaped profiles of the extensions, so that the support plates are fixed. When the swiveling lever is swung open, the profiles of the edges release the tooth-shaped profiles of the longitudinal slots, so that the support plates are displaceable independently of one another along the longitudinal axis of the binding unit.

The swiveling lever is preferably pivoted in a central cover equipped with its own guide element for accommodating the extensions of the support plates. When the two support plates are pushed inwardly towards each other like a telescope, they eventually slide out of the central and outer two guide elements which are connected to the snowboard. In the case of the central guide element, disengagement of the support plates from the guiding circular groove of the cylindrical journal is facilitated by an accommodating recess in the base of each extension which roughly conforms to the cylindrical journal outer diameter- The recesses allow the extensions to slide beyond the center of the cylindrical journal and thus clear of engagement with its circular groove. When completely telescoped inwardly in this manner, the two support plates, together with the swiveling lever and the central cover, are removable from the snowboard as an integral unit.

Another preferred design of the invention consists in providing both support plates with a cover in the area of the boot-rest. For this purpose, each of the support plates has an upwardly cambered shape, and the cover is secured to the support plate in the middle of the longitudinal axis, so that the cover is able to rock about the longitudinal axis with respect to the support plate. Affixed to the undersides of the covers in the outer area are damping elements which support the covers on the guideways in the area where the support plates are slidingly held. For one thing, this allows an attenuated movement of the clamped boot about the longitudinal axis of the binding unit, thus increasing snowboarding ease; and for another thing, the play of the sliding mounting between support plates and guideways is eliminated. In a preferred embodiment, the damping elements for the covers on the support plates are made of a substantially parallelepiped-shaped strip of a resilient plastic.

In a further preferred design of the invention, small adjustment bearing plates can be affixed to the covers in the area of the boot-rest. These adjustment bearing plates may be exchanged and replaced by ones having a different thickness; by this means, the forward lean (so-called "Vorlagenkanting") of the clamped boot can be adjusted. These adjustment bearing plates are preferably affixed to the covers so as to be transversely displaceable. In this way, they can close the recesses of the covers intended to receive lateral edges of the support plates to which the sole-holding shackles are fastened. This stops the attenuated rocking movement of the covers about the longitudinal axis with respect to the support plates.

By affixing covers to the support plates and a central cover, which shield the extensions and the fixing element, and by disposing the guideways in such a way that they are screened by the covers, this binding system also fulfills requirements for an attractive appearance, especially when the covers are made of different colored, match-and-mate plastic parts.

BRIEF DESCRIPTION OF THE DRAWINGS

FIG. 15 is a top plan view of a guide element detachably connected to a snowboard.

FIG. 16 is a section taken on the line XVI—XVI through the guide element of FIG. 15.

DETAILED DESCRIPTION OF THE PREFERRED EMBODIMENT

Figure 1:
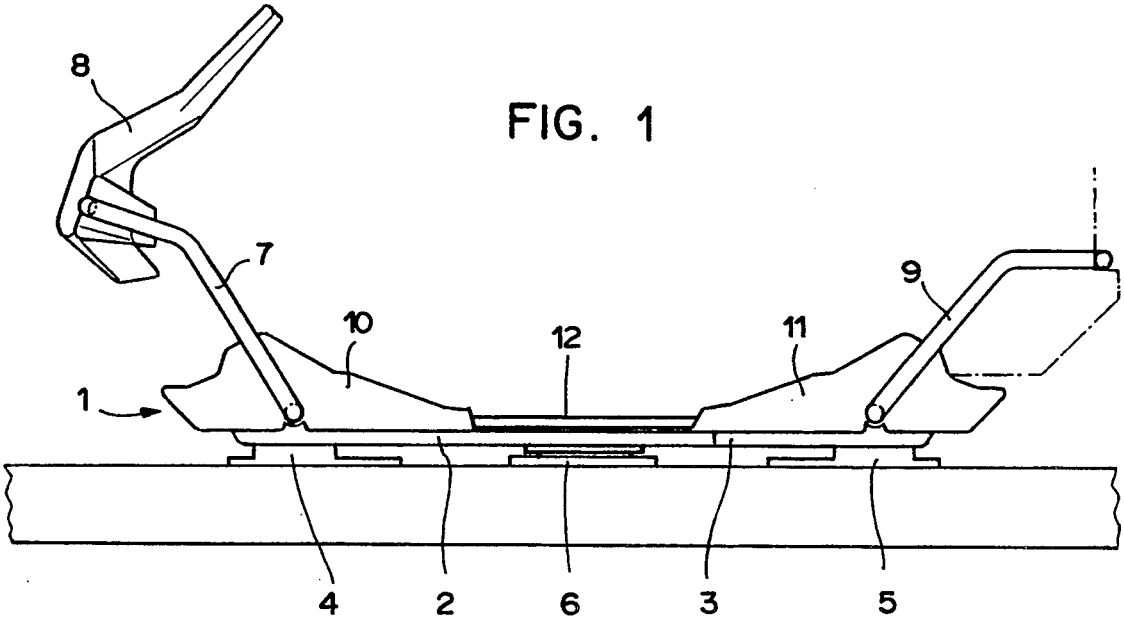
FIG. 1 is an elevation view of a fully equipped binding of this invention.

A binding unit 1 of a binding system for fixing a snowboarder's boots to a snowboard is fastened to the snowboard as shown in FIG. 1 Binding unit 1 is made up of a first support plate 2 and a second support plate 3. Support plate 2 is slidingly guided in the longitudinal direction of binding unit 1 along the longitudinal axis of the boot in a guide element 4 attached to the snowboard. Support plate 3 is correspondingly slidingly guided in a guide element 5 attached to the snowboard. Support plate 2 and support plate 3 are held in a set position by a centrally disposed fixing element 6. Swivelingly mounted in support plate 2 is a front sole holding-down part in the form of a sole-holding shackle 7. A tightener 8 is in turn pivoted on the front sole-holding shackle 7 in a manner which is well known in the art A rear sole holding-down part in the form of a sole-holding shackle 9 is swivelingly mounted on support plate 3. Held on support plates 2, 3 are respective covers 10 and 11 on which the front and back ends, respectively, of the sole of the boot secured in binding unit 1 come to rest. When fixing element 6 is released, support plates 2, 3 are movable longitudinally toward and away from each other, independently of one another. Binding unit 1 can thereby be set to any desired boot length. Furthermore, the position of the boot's longitudinal axis relative to the snowboard can also be modified thereby. The ends of support plates 2, 3 facing one another extend under a central cover 12 held stationary by fixing element 6.

Figure 2:
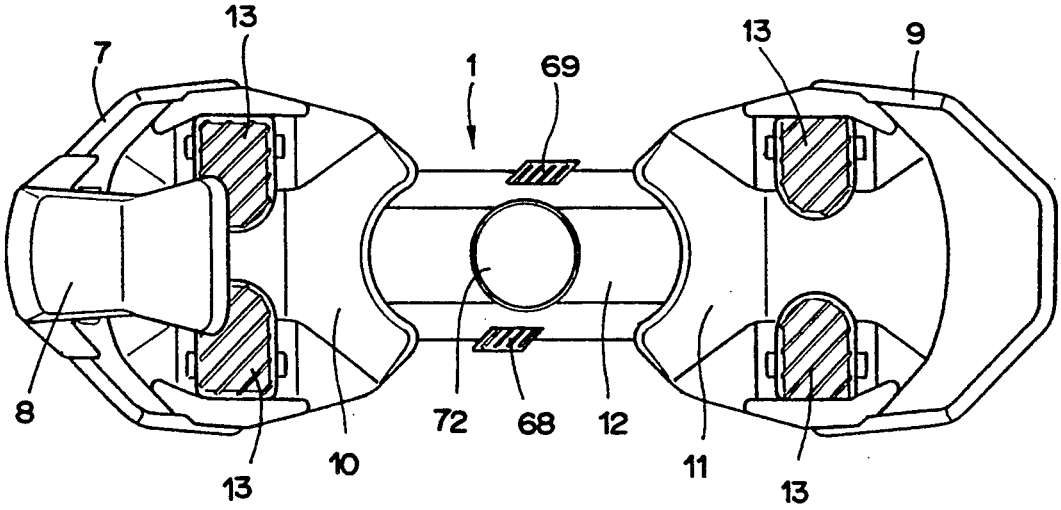
FIG. 2 is a top plan view of a fully equipped binding of this invention.

As may be seen in FIG. 2, two small adjusting bearing plates 13 are affixed to the upper side of each of the covers 10 and 11 adjacent to shackles 7 and 9. These small bearing plates 13 serve as support surfaces for the sole of the boot held by binding unit 1. A journal-shaped elevation 72 for fixing element 6 is disposed in central cover 12. Projecting laterally beyond central cover 12 are operating levers 68, 69 by means of which fixing element 6 may be brought from the position in which support plates 2, 3 are secured into a position in which these support plates are released for longitudinal displacement.

Figure 3:
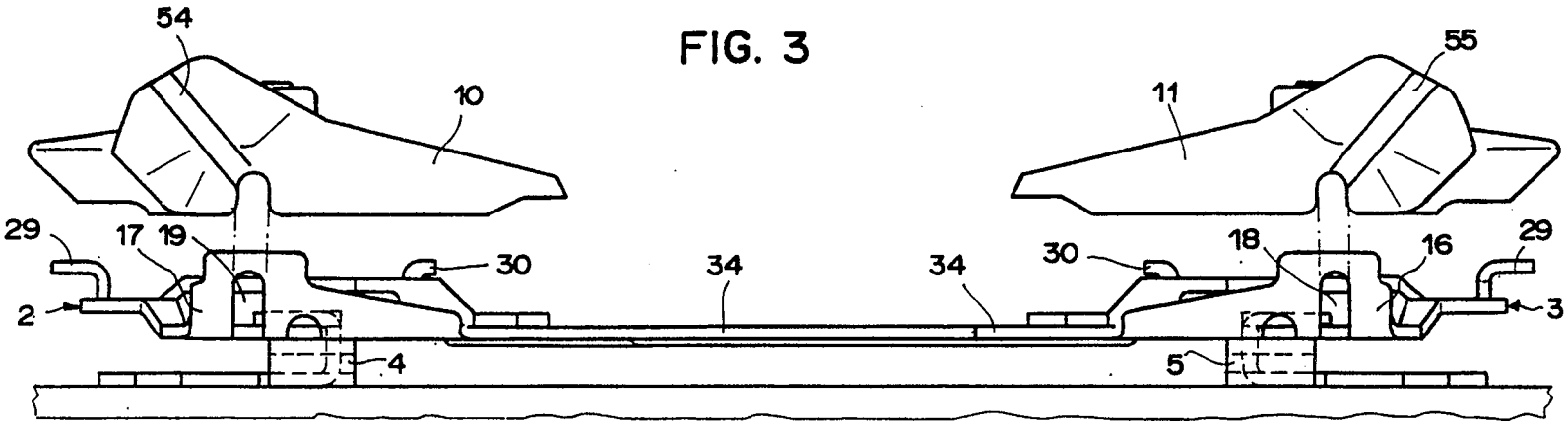
FIG. 3 is an elevation of a binding unit of this invention with covers removed.
Figure 4:
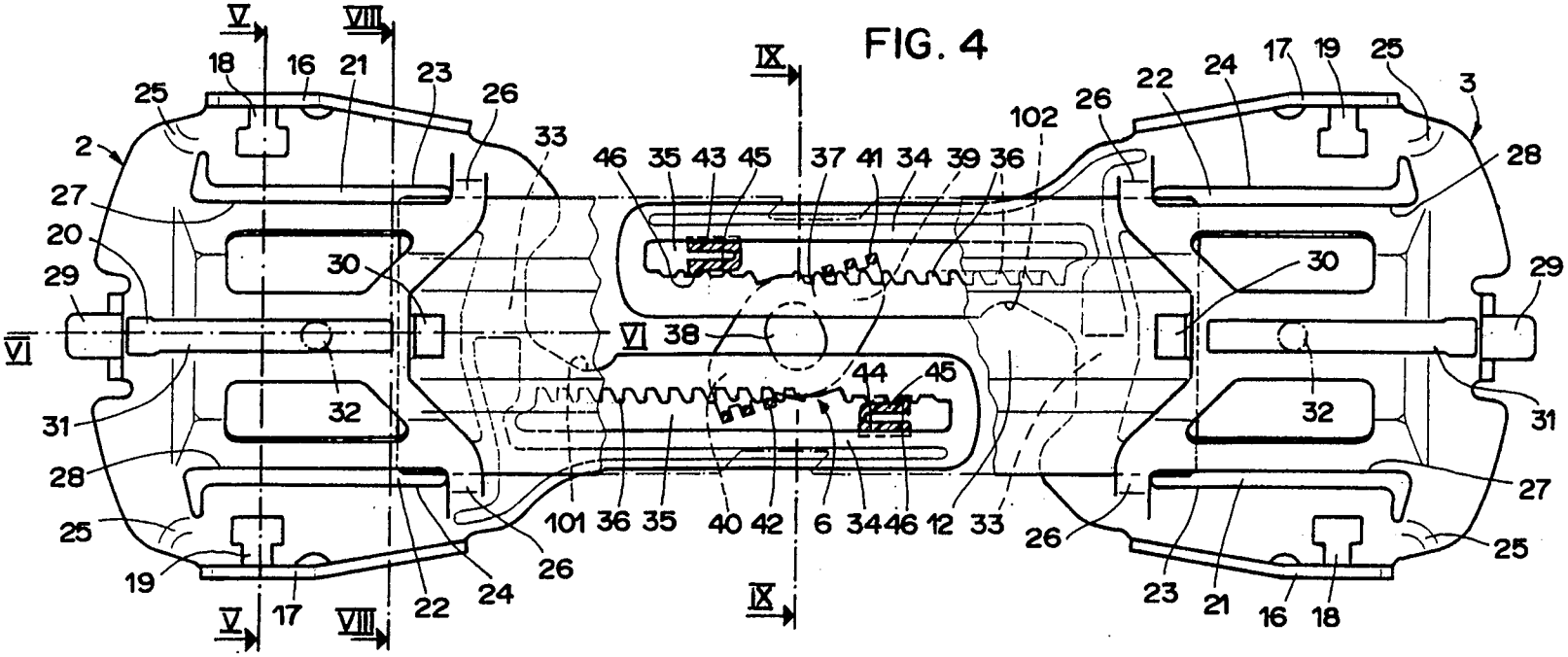
FIG. 4 is a top plan view of a binding unit of this invention with laterally removed covers and the middle cover partially in section.

FIGS. 3 and 4 illustrate the design of support plates 2, 3, as well as the mode of operation of the centrally disposed fixing element 6. The two support plates 2, 3 are identical and are each provided along their long sides with angled edges 16 and 17. Each of these edges 16, 17 includes a slot-shaped recess 18, 19, closed at the top, for receiving the projection-bearing end of a sole-holding shackle 7, 9. For introducing the shackles into slot-shaped recesses 18, 19, the latter are broadened in the support-plate bottoms in such a way that the projections of the shackle can be passed through. In this area, support plates 2, 3 are somewhat wider than the boot sole.

Toward the central longitudinal axis 20 of binding unit 1, slots 21, 22,.disposed parallel to longitudinal axis 20, are formed in the bottoms of support plates 2, 3. The outer edges 23, 24 of slots 21, 22 serve as sliders which engage matching groove-shaped recesses in guide elements 4, 5, and along which support plates 2, 3 are displaceable in the direction of longitudinal axis 20 of binding unit 1. In the regions designated 25 and 26, each of the support plates 2, 3 is curved upward in such a way that these plates present a domed shape. Owing to this camber, the inner edges 27, 28 of slots 21, 22 are at a different level from the outer edges 23, 24, thus creating room for the longitudinal guideways.

Formed on each of the support plates 2, 3 in longitudinal axis 20 are two retaining hooks 29 and 30 serving to hold covers 10 and 11. Between retaining hooks 29 and 30, support plates 2, 3 each have a guide slot 31 situated on longitudinal axis 20 of binding unit 1. Into guide slots 31 there project guide bolts 32 secured to guide elements 4 and 5, respectively, for ensuring longitudinal guiding of support plates 2, 3.

When support plates 2, 3 are completely pushed together, i.e., telescoped, outer edges 23 and 24 serving as sliders slide inwardly and eventually clear of the guideways of guide elements 4, 5 so that support plates 2, 3 are released. Guide bolt 32 is then situated in the outside area of guide slot 31. In this position, support plates 2, 3 can be lifted off guide elements 4, 5.

Toward the middle of binding unit 1, support plates 2, 3 are each provided with a crossbar 33 running at right angles to longitudinal axis 20. Crossbars 33 are not curved upward like the described area forming the boot-end rests of support plates 2, 3 but are situated substantially in the plane formed by the undersides of edges 16 and 17. Affixed to the side of each crossbar 33 is an extension 34 running parallel to longitudinal axis 20. Each extension 34 is provided with an elongated slot 35 which likewise runs parallel to longitudinal axis 20 and includes a toothed profile 36 on the inner side thereof.

Disposed centrally in binding unit 1 is a swiveling lever 37 provided with a center opening 38 by means of which lever 37 can be pivoted on a centrally disposed journal attached to the snowboard. Swiveling lever 37 and this journal form central fixing element 6. Lever 37 has two arms 39 and 40 having respective angled edges 41 and 42 on one side, these edges running substantially tangentially away from center opening 38 of lever 37. Formed into edges 41 and 42 is a profile matching toothed profiles 36 of extensions 34 of support plates 2, 3, respectively. Lever 37 is disposed under the two extensions 34 of support plates 2, 3 in such a way that profiled edges 41 and 42 each protrude from below into one of the elongated slots 35 of extensions 34 of support plates 2, 3. When lever 37 is swiveled closed, the profiles of edges 41 and 42 engage the toothed profile 36 of extension 34 of each support plate 2 and 3, whereby these plates are held in the set position so that longitudinal displacement is blocked. Swiveling lever 37 is so disposed that the profiles of edges 41 and 42 are pulled into the toothed profile 36 of the respective extension 34 when a boot is clamped in binding unit 1. The clamped boot causes traction to be exerted upon support plates 2, 3, and consequently upon extension 34, which is directed outwardly from central fixing element 6. For displacing support plates 2, 3 longitudinally, lever 37 is swiveled open, whereby the profiles of edges 41 and 42 release toothed profile 36 of extension 34 of the respective support plates 2, 3, so that longitudinal displacement of these plates becomes possible.

Swiveling lever 37 is attached to central cover 12, which is shown partially in section in FIG. 4. Viewed from above, central cover 12 shields the extension 34 of each of the support plates 2, 3. Secured to central cover 12 are guide elements 43 and 44, each of which projects into one of the elongated slots 35 in extensions 34 of support plates 2, 3, whereby extensions 34 are slidingly guided in the longitudinal direction of binding unit 1. Each guide element 43, 44 comprises a resilient portion 45 having a projection 46 formed thereon, this projection being so disposed that it can snap into toothed profile 36 of slot 35 in each support plate 2, 3. Upon longitudinal displacement of these support plates, a prepositioning can thereby take place, which facilitates the swivel closing of lever 37 and engagement of the profiles of the respective arms 39 and 40 with toothed profile 36.

At support plates 2, 3, central cover 12 lies above crossbars 33, whereas in the area of the boot rest, it extends under support plates 2, 3 owing to their domed shape. Extensions 34 of support plates 2, 3 each run beneath the crossbar 33 of the adjacent support plate 2 or 3, respectively, each such crossbar including on the underside thereof a recess providing space for receiving the opposite extension 34 moving under support plate 2 or 3.

Figure 5:
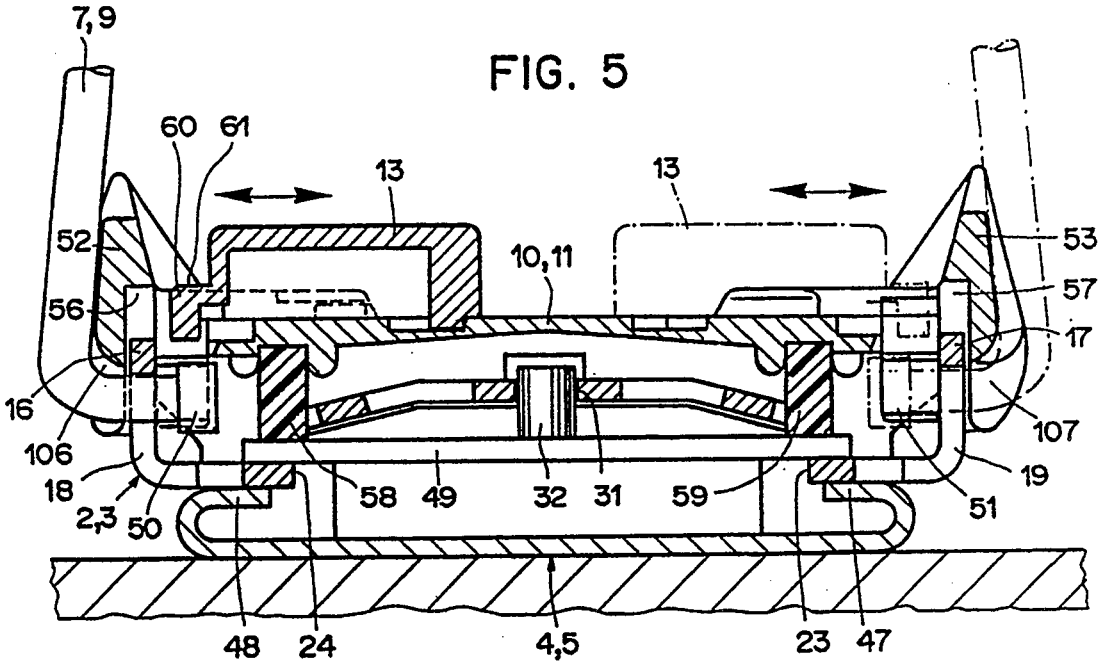
FIG. 5 is a section taken on the line V—V of FIG. 4, with the cover mounted.

FIG. 5 is a cross-section taken on the line V—V of FIG. 4 through guide element 4 and support plate 2 with cover 10 in place. The following description applies equally to identical guide element 5, support plate 3, and cover 11. Guide element 4, detachably connected to the snowboard, has bent-back lateral flanges 47 and 48 upon which the area of support plate 2 situated outside the outer edges 23, 24 of slots 21, 22 is supported. The upper guide track of this sliding guideway is formed by a connection plate 49 affixed transversely to guide element 4. Affixed to the middle of connection plate 49 is guide bolt 32, which projects into guide slot 31 of support plate 2. This cross-sectional view shows the upwardly curving shape of support plate 2. To the left and right of this plate are bent edges 16 and 17, the slot-shaped recesses 18 and 19 of which are intended to receive sole-holding shackle 7 (or 9). Shackles 7, 9 are secured against being pulled out by projections 50, 1 resting on the flanks of recesses 18, 19.

Figure 6:
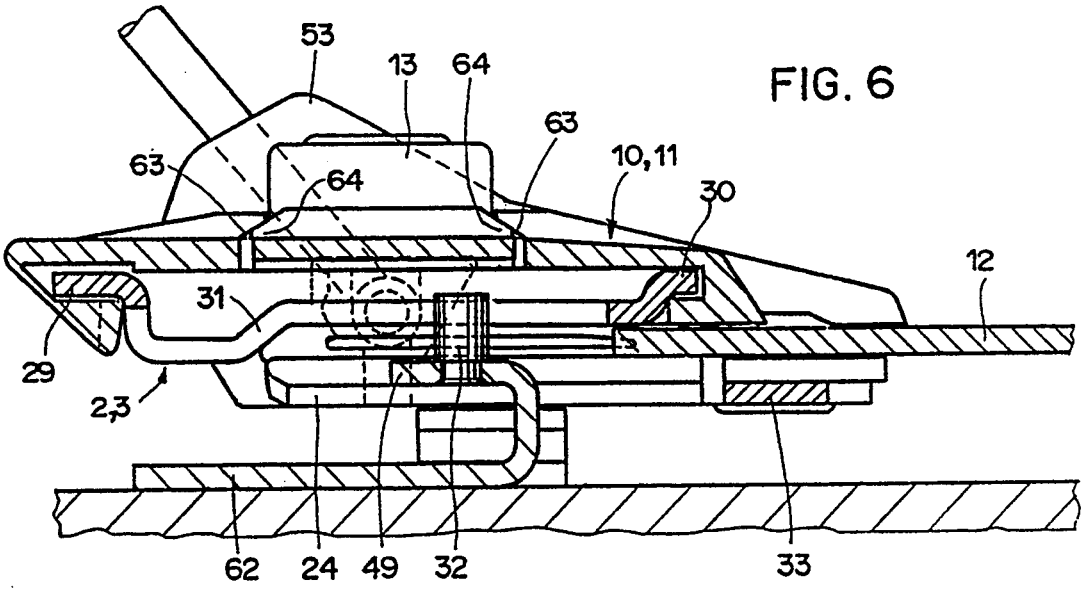
FIG. 6 is a section taken on the line VI—VI of FIG. 4 with the cover mounted.

Mounted on support plate 2 is cover 10, held by retaining hooks 29 and 30 (FIG. 6). Cover 10 projects laterally beyond bent edges 16 and 17 of support plate 2 and overlaps them. In the areas where shackle 7 is fastened, cover 10 is provided with slots 106 and 107 corresponding approximately to slot-shaped recesses 18, 19 situated below them. On each side, cover 10 includes a raised portion 52, 53 serving as a lateral guiding aid for the boot soles, especially when stepping in. Raised portions 52, 53 include channels 54 and 55 (FIG. 3) into which sole-holding shackles 7, 9 spring owing to the slight bias, whereby shackles 7 and 9 can be held in a preferred position—which may be called the entry position for the boot—and whereby stepping into the binding system is facilitated.

A small adjustment bearing plate 13 is affixed on both sides of cover 10. The sole of the boot to be clamped in binding unit 1 is supported on these bearing plates 13, a total of four of which are affixed per binding unit 1. Adjustment bearing plates 13 are transversely displaceable with respect to longitudinal axis 20 as shown by the indicated double arrows.

In the vicinity of angled edges 16, 17 of support plate 2, cover 10 includes recesses 56 and 57 designed so that when cover plate 10 is pressed against support plate 2, edges 16 and 17 can enter recesses 56 and 57, respectively. This rocking movement of cover plate 10 about longitudinal axis 20 is made possible by the axial mounting through retaining hooks 29, 30 and the upwardly cambered shape of support plate 2. For attenuating this rocking movement of cover plate 10 relative to support plate 2, damping elements 58 and 59 are affixed on each side of cover 10. Damping elements 58, 59 each consist essentially of a rectangular parallelepiped shape, the underside of which rests on connection plate 49 of guide element 4, and the length of which is such that in each fixable position of support plate 2, cover 10 is actually still supported on connection plate 49. Damping elements 58, 59, made of a resilient material, allow an attenuated rocking movement of cover 10, and hence of the clamped boot, with respect to longitudinal axis 20 of binding unit 1, thus increasing ease of snowboarding.

Figure 7:
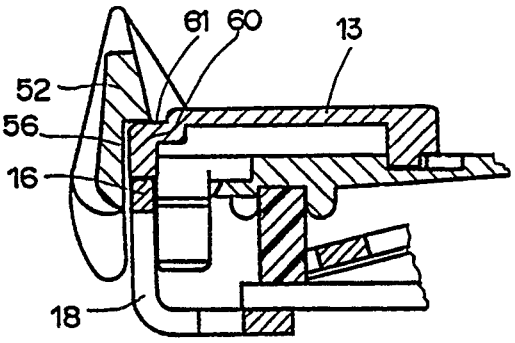
FIG. 7 is a detail of FIG. 5 showing a different position of the small bearing plate.

This attenuated rocking movement of cover 10 can be stopped as shown in FIG. 7. For preventing the rocking movement, small adjustment bearing plates 13 can be moved outward from the position illustrated in FIG. 5 to that depicted in FIG. 7, which applies equally to all four bearing plates 13. The outer part 60 of plate 13 enters recess 56 of cover 10, whereby the top surface 61 of outer part 60 comes in contact with the top edge of recess 56, while the underside of outer part 60 rests on the top face of angled edge 16. When both bearing plates 13 of a cover (10 or 11) are moved into this outside position, the rocking movement of the cover relative to the support plate is stopped.

Adjustment bearing plates 13 may be exchanged and replaced by ones of a different thickness. Thus, two plates 13 of equal thickness may be used with front cover 10, while two thicker plates 13 of equal thickness are used with rear cover 11, so that there will be a difference in level between the toe end of the boot as compared with the heel end. The forward lean (so-called "Vorlagenkanting") can thereby be adapted to the individual requirements of the snowboard user and adjusted accordingly.

According to FIG. 6, a sectional view taken on the line VI—VI of FIG. 4, connection plate 49 consists of one leg of a U-shaped base plate 62 of which guide elements 4, 5 are formed. Between flanges 47 and 48 (FIG. 5) and connection plate 49, support plate 2, 3 is held slidingly in the longitudinal direction of binding unit 1, as may be seen from the view of the outer edge 24 of support plate 2, 3. Secured to connection plate 49 is guide bolt 32 which engages in guide slot 31. Disposed at the forward and rearward ends of slot 31 are retaining hooks 29 and 30, by means of which cover 10, 11 is held. Small adjustment bearing plate 13 is slidingly held in a groove-shaped recess 63 by means of matching projections 64 formed on bearing plate 13.

When support plates 2, 3 are longitudinally displaced, central cover 12 slides into the cavity created by the camber of support plates 2, 3, i.e., it runs above crossbar 33 of support plates 2, 3, on the one side, and below the domed area of support plates 2, 3, and thus below cover 10, 11, on the other side.

Figure 8:
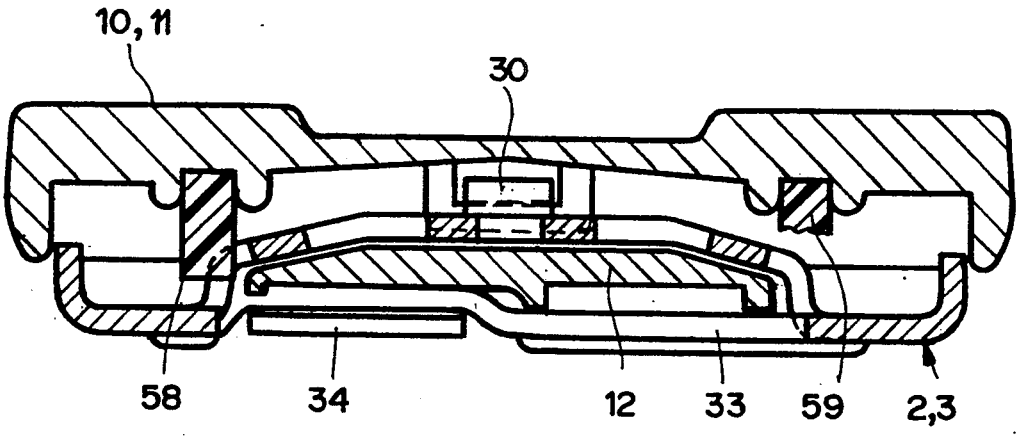
FIG. 8 is a section taken on the line VIII—VIII of FIG. 4 with the cover mounted.

The sectional view of FIG. 8 shows the camber of support plate 2 (or 3). Here it may be seen, as already described, that central cover 12 runs above crossbar 33 and below the curvature of support plates 2, 3. Extension 34 (not visible) is affixed to the right-hand side of crossbar 33, as viewed in FIG. 8. On the left-hand side, crossbar 33 has a recess in which extension 34 of the opposite support plate 3 (or 2) runs. This sectional view further shows cover 10, 11, damping elements 58, 59, and retaining hook 30 for holding cover 10, 11.

Figure 9:
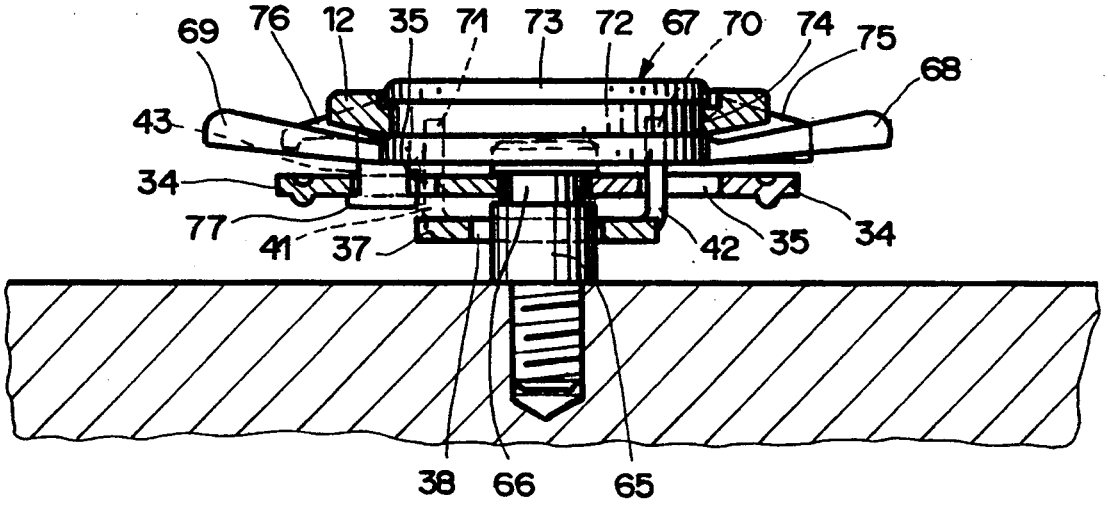
FIG. 9 is a section taken on the line IX—IX of FIG. 4 through the central fixing element.

FIG. 9 is a section taken on the line IX—IX of FIG. 4 through central fixing element 6 which consists of a cylindrical journal 65 fastened to the snowboard. At the top, journal 65 includes a circular groove 66 in which the inner sides of the respective extensions 34 of support plates 2, 3 are guided. When support plates 2, 3 are completely telescoped, or slid inwardly along the longitudinal axis toward each other, recesses 101 and 102 (FIG. 4), situated at the base of extensions 34 of support plates 2, 3 on the inner sides thereof, are adjacent to or even with cylindrical journal 65. In this position, extensions 34 are no longer guided in groove 66 of journal 65. Hence support plates 2, 3, along with the associated covers 10, 11 and central cover 12, which are held together as a unit by swiveling lever 37 and a control element 67 as will be described below, can be lifted off the snowboard and removed. Pivoted on journal 65 is swiveling lever 37, into which journal 65 projects through center opening 38 thereof. Swiveling lever 37 is disposed between the snowboard and extensions 34 of the respective support plates 2, 3. The two edges 41, 42 of lever 37, having toothed profiles, project from below through elongated slots 35 of the respective extensions 34. Mounted on swiveling lever 37 from above is control element 67, provided with wings 68 and 69 projecting out beyond central cover 12 (see also FIG. 2), by means of which lever 37 can be turned by hand. For mounting in control element 67, edges 41 and 42 of swiveling lever 37 are each provided with a projection 70, 71 engaging and locking in matching recesses in control element 67. Control element 67 comprises a knob-like top 72 having a rib 73 around its upper rim. Knob-like top 72 of control element 67 is inserted from below into a center opening 74 of central cover 12. By means of the annular thickening rib 73, which is resiliently compressed when inserted into central cover 12 and snaps in upon reaching its end position in cover 12, control element 67 is pivotingly held in cover 12. In the region of wings 68 and 69 of control element 67, central cover 12 has laterally disposed cut-outs 75 and 76, by which space is made for wings 68 and 69. Secured to the underside of central cover 12 are guide elements 43 and 44 (only guide element 43 being visible in FIG. 9), each of which projects into the elongated slot 35 of the associated extension 34. Each guide element 43, 44 has at the bottom a collar 77 for securing the extension 34 also against vertical sliding.

Figure 10:
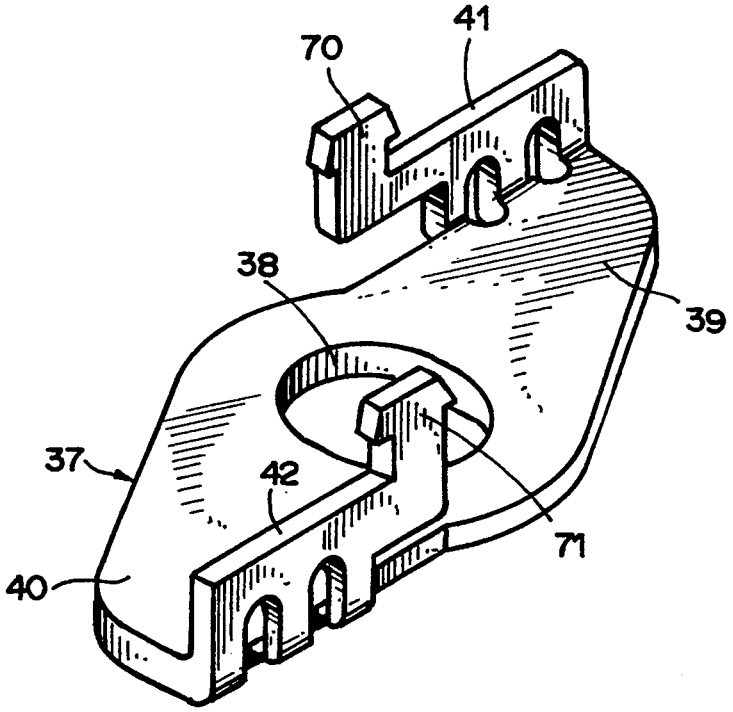
FIG. 10 is a perspective view of the swiveling lever for fixing the support plates.

FIG. 10 is a perspective view of swiveling lever 37 provided with center opening 38. Formed on its arms 39 and 40 are respective edges 41, 42 having profiles which mesh with the matching toothed profiles 36 of elongated slots 35 of extensions 34. Integral with each edge 41, 42 is projection 70, 71 by means of which swiveling lever 37 is held in control element 67.

Figure 11:
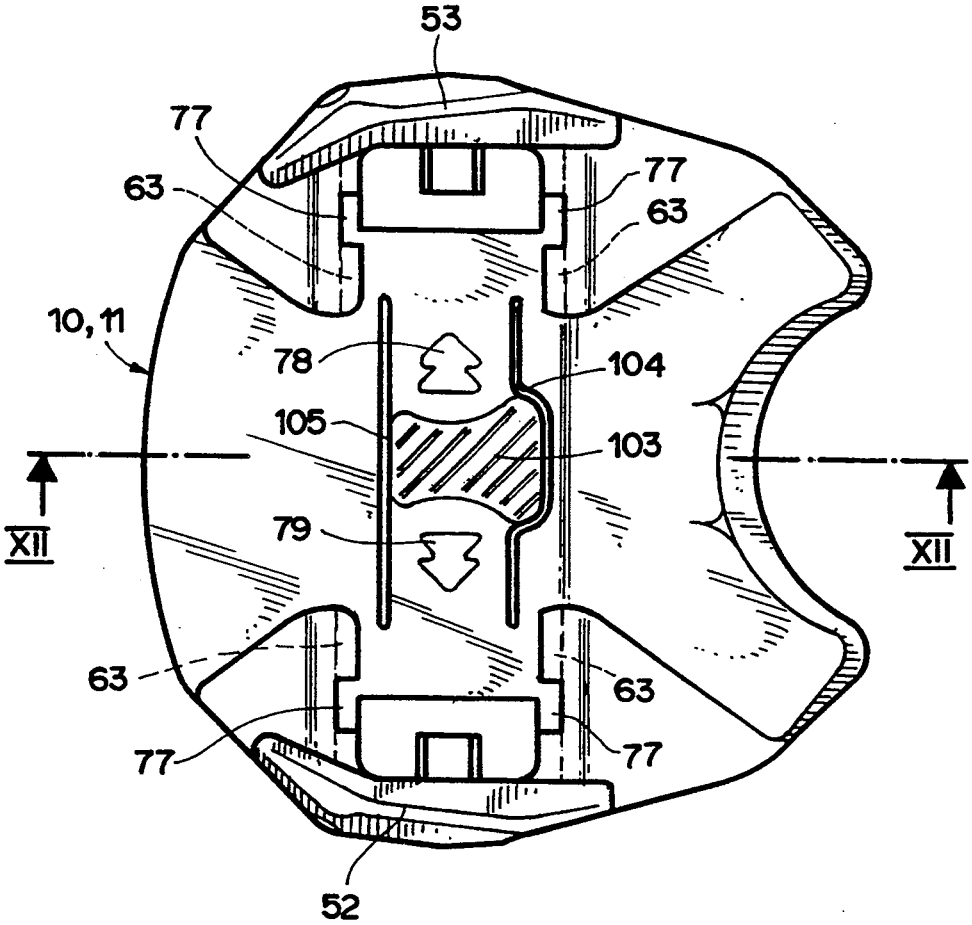
FIG. 11 is a top plan view of a cover for a support plate.

FIG. 11 is a top plan view of a cover 10 or 11. On each side of cover 10, 11 is a raised portion 52, 53 serving particularly as lateral guidance for the boot upon stepping into the binding unit. Also shown on each side of cover 10, 11 are groove-shaped recesses 63 for receiving small adjustment bearing plates 13, which are displaceable along these recesses. Each groove-shaped recess 63 includes a cut-out 77 for insertion of bearing plates 13. For positioning bearing plates 13 in the transversely displaceable position, there are depressions 78 and 79 in the shape of interlocking double triangles on both sides of cover 10, 11. The mode of operation of depressions 78, 79 will be described in conjunction with the small bearing plates illustrated in FIG. 14.

Figure 12:
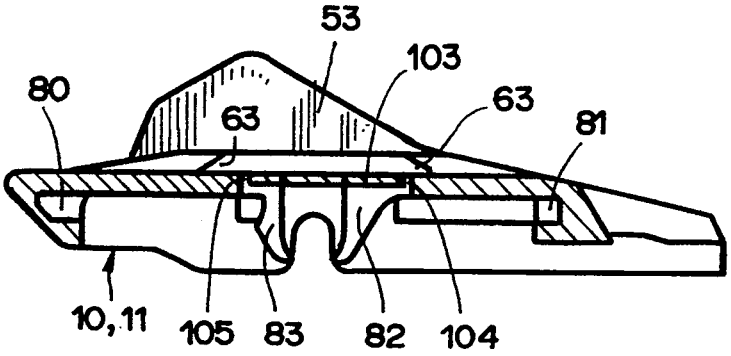
FIG. 12 is a section taken on the line XII—XII through the cover of FIG. 11.

FIG. 12 is a sectional view taken on the line XII—XII of FIG. 11 through a cover 10 or 11. Here lateral raised portion 53 is visible, as well as groove-shaped recess 63 for receiving a small adjustment bearing plate 13. Shown further are receiving apertures 80 and 81 in which retaining hooks 29, 30 of support plates 2, 3 engage. Joined in the vicinity of the lateral recess for receiving the sole-holding shackles are two hook-shaped holders 82 and 83, between which a respective projection 50, 51 (FIG. 5) of a sole-holding shackle comes to lie and is held when the shackle is inserted.

Figure 14:
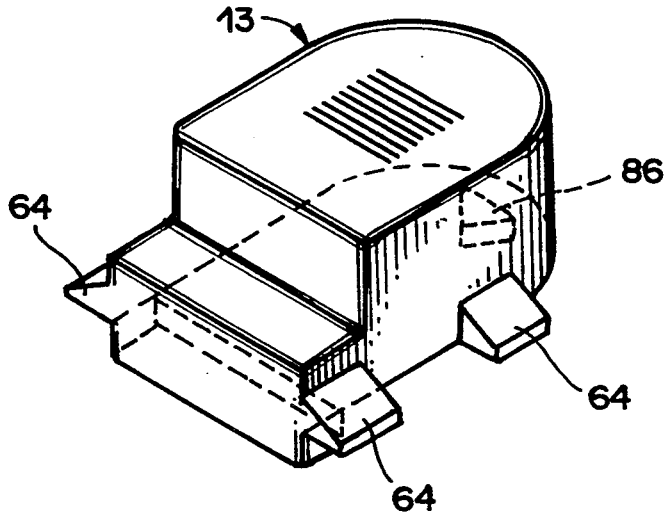
FIG. 14 is a perspective view of a small adjustment bearing plate.

FIG. 14 is a perspective view of a small adjustment bearing plate 13 insertable in groove-shaped recesses 63 (FIGS. 11, 12) on both sides of covers 10, 11. Bearing plate 13 comprises projections 64 which are guided in recesses 63 of cover 10, 11. As described in connection with FIGS. 5 and 7, bearing plates 13 may assume two positions on covers 10, 11, one of which allows the attenuated rocking movement of cover 10, 11 relative to support plate 2, 3, while the other position prevents such rocking. For fixing bearing plate 13 in these two positions, it includes on the underside a triangular protrusion 86 which engages the respective depression 78, 79 of cover 10, 11 (FIG. 11), thus establishing the front and rear positions of the small adjustment bearing plate 13 relative to cover 10, 11.

Figure 13:
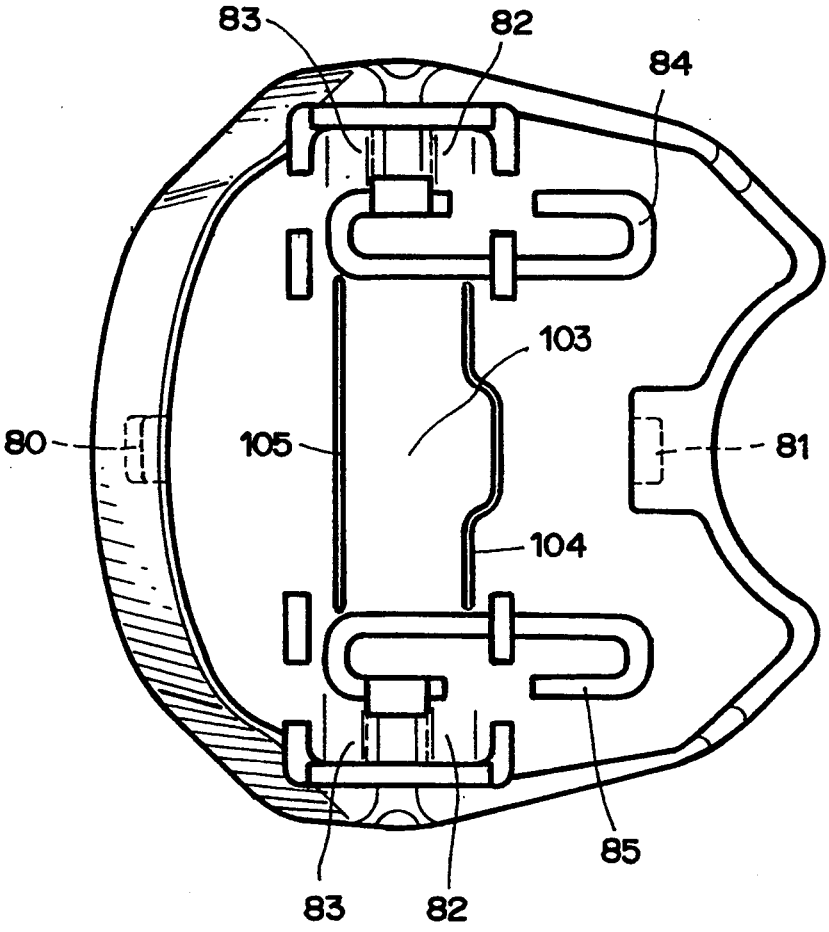
FIG. 13 is a bottom view of a cover for a support plate.

For shifting bearing plates 13 with respect to the associated covers 10, 11, the latter are each provided with a centrally disposed, resilient crosspiece 103, as may be seen in FIGS. 11, 12, and 13. It is on crosspiece 103, which is separated from cover 10, 11 by two slits 104 and 105, that depressions 78 and 79 are situated. Crosspiece 103 can be pressed down (against the snowboard), whereupon depressions 78 and 79 free triangular protrusions 86 (see FIG. 14) of bearing plates 13 so that they can be displaced. When crosspiece 103 is released, it springs back into its original position, and triangular protrusion 86 snaps into the respective depression 78 or 79.

FIGS. 15 and 16 show a means of fixing guide elements 4 and 5 adjustably to the snowboard. In each guide element 4, 5 a respective support plate 2, 3 is slidingly guided along the longitudinal axis of binding unit 1. Secured to the snowboard are two cylindrical pins 87, 88 per guide element 4, 5. Base plate 62 of guide element 4, 5 can be mounted on these two cylindrical pins 87 and 88, the base plate having for this purpose on one side a slot-shaped recess 90, the width of which is slightly greater than the diameter of cylindrical pin 88 which is received in this slot, and on the other side an accurate row of holes 91, the individual holes of this row having a slightly larger diameter than cylindrical pin 87 and optionally overlapping. By means of row of holes 91, a number of positions which guide element 4, 5 may assume can be fixed. The angular position of a binding unit 1 relative to the longitudinal axis of the snowboard may thus be adjusted. The two guide elements 4 and 5, situated opposite one another with respect to central fixing element 6, must be aligned with respect to central fixing element 6 upon fastening to the snowboard. Slot-shaped recess 90 and row of holes 91 are so disposed that when guide element 4, 5 is adjusted laterally, the distance from fixing element 6 always remains the same. After guide element 4, 5 is mounted in the predetermined position on cylindrical pins 87 and 88, clamping elements 92 and 93 are pushed over cylindrical pins 87 and 88, which are each provided with a circular groove 94. For this purpose, clamping elements 92 and 93 include respective slots 95 and 96, the side edges of which engage the circular groove 94 of the associated cylindrical pin 87, 88 in such a way that clamping elements 92, 93 are held axially by grooves 94 of pins 87 and 88. In order to hold clamping elements 92 and 93 in the position pushed onto pins 87 and 88, the latter are rotatably disposed on a yoke 97.

In the position of yoke 97 illustrated in FIGS. 15 and 16, this yoke being so shaped that it encompasses guide element 4, 5, its operating side 98 comes to lie under the respective support plate 2 or 3 held by guide element 4 or 5. Yoke 97 is thereby kept from coming loose during snowboarding. Not only are guide elements 4, 5 held by yoke 97 and clamping elements 92, 93, but clamping elements 92, 93 are braced by flipping yoke 97 from a vertical position into the position shown in FIGS. 15 and 16 relative to cylindrical pins 87 and 88. This is done by providing yoke 97, made of a round rod, with a flat 99 in the vicinity of clamping elements 92 and 93. Flat 99 acts like an eccentric which lifts clamping elements 92 and 93 relative to base plate 89 when yoke 97 is folded down, and thus presses base plate 89 against the snowboard with respect to cylindrical pins 87 and 88. For ease of handling, yoke 97 is provided on operating side 98 with a handle 100.

For adjusting guide elements 4 and 5 relative to central fixing element 6, support plates 2, 3 are moved into the telescoped position, whereby they are disengaged from guide elements 4 and 5, and whereby the extensions 34 of the respective support plate 2, 3 are released by cylindrical journal 65 of central fixing element 6, so that support plates 2, 3, which together with covers 10, 11, as well as central cover 12 and the central fixing mechanism, form a unit, can be lifted off the snowboard. Yoke 97 can then be lifted into the vertical position, after which clamping elements 92 and 93 may be pulled off cylindrical pins 87 and 88. After adjustment-of guide elements 4 and 5, refastening takes place in the reverse order of the foregoing release operation.

Four cylindrical pins 87 and 88 for each of the two binding units 1 may be affixed to the snowboard both for the "regular" position and for the "goofy" position. The changeover of the position on the snowboard from "regular" to "goofy" can thereby be carried out by simple shifting of guide elements 4 and 5 of the two binding units 1. Covers may be placed over the pins 87, 88 not being used.

In one embodiment of the inventive binding system described above, support plates 2, 3, guide elements 4, 5, and swiveling lever 37 of the central fixing element 6 are made from a stainless steel plate, particularly by stamping and bending, while all other parts, especially covers 10, 11 and central cover 12, are made of plastic. Besides the shape and form, an additional esthetic effect can be achieved by a suitable choice of colors.

What is claimed is:

1. An adjustable length binding unit for securing a boot to a gliding board comprising:

forward and rear sole-holding means;

an opening device associated with at least one of said sole-holding means;

two independently slidable support plates, oppositely disposed along the longitudinal axis of the binding unit, for holding the forward and rear sole-holding means respectively; each of said support plates having an extension which is disposed laterally and runs parallel to the longitudinal axis of the support plate and, in each case, is directed toward the opposite support plate such that said extensions lie next to each other;

two spaced apart guide elements, one for each of said support plates, for slidably guiding each respective support plate independently of the other said support plate and in direction parallel to said longitudinal axis of the binding unit;

means for connecting said guide elements to the gliding board comprising a base plate formed on each of said guide elements and removably and adjustably mounted to the gliding board;

a single fixing element, operable without the aid of tools and centrally disposed along the longitudinal axis of the binding unit, for selectively engaging both of said extensions of said independently slidable support plates simultaneously, whereby engagement of said extensions by said fixing element fixes the position of said extensions along the longitudinal axis of the binding unit and disengagement therefrom allows each of said extensions to be manually, independently, and slidably displaced along the longitudinal axis of the binding unit so that variable heel and toe spans from said fixing element are establishable; and means for securing said fixing element to the gliding board.

2. The adjustable length binding unit of claim 1, wherein a support plate cover for each of said support plates is detachably mounted thereto and a central cover is detachably mounted to said fixing element.

3. An adjustable length binding unit for securing a boot to a gliding board, comprising:

forward and rear sole-holding means;

an opening device associated with at least one of said sole-holding means;

two independently slidable support plates, oppositely disposed along the longitudinal axis of the binding unit, for holding said forward and rear sole-holding means respectively, each of said support plates having an extension which is disposed laterally and runs parallel to the longitudinal axis of the support plate and, in each case, is directed toward the opposite support plate such that said extensions lie next to each other;

two spaced apart guide elements, one for each of said support plates, for slidably guiding each respective support plate independently of the other said support plate and in a direction parallel to said longitudinal axis of the binding unit; each of said guide elements including a central longitudinal groove-shaped recess having a pair of side walls extending therealong;

means for connecting said guide elements to the gliding board comprising a base plate formed on each of said guide elements and removably and adjustably mounted to the gliding board;

a single fixing element, operable without the aid of tools and centrally disposed along the longitudinal axis of the binding unit, for selectively engaging both of said extensions of said independently slidable support plates simultaneously, whereby engagement of said extensions by said fixing element fixes the position of said extensions along the longitudinal axis of the binding unit and disengagement therefrom allows each of said extensions to be manually, independently, and slidably displaced along the longitudinal axis of the binding unit so that variable heel and toe spans from said fixing element are establishable; and means for securing said fixing element to the gliding board.

a support plate cover for each of said support plates being detachably mounted thereto;

a central cover detachably mounted to said fixing element; and wherein each of said support plates includes, at the end remote from said fixing element, two slider edges disposed parallel to the longitudinal axis of said support plates, said pair of side walls of said groove-shaped recess being slidingly engaged by a corresponding pair of slider edges on the respective support plate.

4. The adjustable length binding unit of claim 3, wherein each of said extensions includes an elongated slot having a toothed profile formed on the inner long side thereof.

5. The adjustable length binding unit of claim 4, wherein said fixing element is a cylindrical journal perpendicularly to said gliding board in the center of said binding unit, further comprising a swiveling lever having a center opening and two arms, each of said arms having a profiled, bent edge on each side thereof running substantially tangentially away from said center opening, said swiveling lever being pivoted on said journal, each said bent edge projecting into a respective said elongated slot and engaging a said toothed profile.

6. The adjustable length binding unit of claim 5, wherein said cylindrical journal includes a circular groove near the top thereof, each of said extensions of said support plates having an inner long edge engaging said circular groove substantially tangentially and being guided therein.

7. The adjustable length binding unit of claim 6, wherein said central cover comprises two guideways, said swiveling lever further comprising operating elements for manual adjustment and being pivoted in said central cover, said extensions of said support plates being slidingly guided in said guideways for mutual telescoping of said support plates with said central cover to form a single unit.

8. The adjustable length binding unit of claim 7, wherein said extensions each have a base opposite said cylindrical journal; said base include a complimentary-shaped recess for accommodating said cylindrical journal such that when said support plates are slid inwardly toward each other into a telescoped position wherein said slider edges of said support plates have slid out of said groove-shaped recesses on said guide elements and said complimentary-shaped recesses provide clearance sufficient between said extensions and said cylindrical journal to allow said support plates, said support-plate covers, and said central cover to be compacted into an intergrated unit and removed from the gliding board without the use of tools.

9. The adjustable length binding unit of claim 4, wherein said support plates are so designed that said extensions of said support plates run beneath said central cover, said support plates each having a boot-rest area and an upwardly cambered shape in said boot-rest area, whereby said central cover is insertable beneath said support plates.

10. The adjustable length binding unit of claim 9, further comprising retaining means disposed centrally on said longitudinal axis, each of said support-plate covers being situated in said boot-rest area and being held by said retaining means in such a way as to enable a rocking movement of said support-plate covers about said longitudinal axis.

11. The adjustable length binding unit of claim 10, further comprising damping elements affixed on each side of each support-plate cover for attenuating said rocking movement of said support-plate cover relative to said support plates, said damping elements being supported on said guide elements forming said groove-shaped recesses.

12. The adjustable length binding unit of claim 11, wherein each of said damping elements is a rectangular parallelepiped body made of a resilient thermoplastic material.

13. The adjustable length binding unit of claim 4, wherein said support plates each have a boot-rest area, the lateral margins of said support plates being bent upwardly in said boot-rest areas, the edges thus formed serving to hold said sole-holding means, on the one hand, and projecting into respective recesses made in said support-plate covers, on the other hand, said support-plate covers having in said boot-rest areas transversely displaceable small adjustment bearing plates which, in one position, leave said recesses of said support-plate covers free for receiving said edges, whereby a rocking movement of said support-plate covers about said longitudinal axis relative to said support plates is possible and, in another position, close said recesses of said support-plate covers and rest upon said edges of said support plates.

14. The adjustable length binding unit of claim 13, wherein said small adjustment bearing plates are exchangeable so that small adjustment bearing plates of differing thicknesses can be utilized.

15. The adjustable length binding unit of claim 13, wherein one or more of said support plate covers, central cover, small adjustment bearing plates are made of plastic material.

16. The adjustable length binding unit of claim 3 wherein said guide elements are held on the gliding board by mean of a detachable connection for adjusting the angle of the longitudinal axis of the boot with respect to the longitudinal axis of the gliding board, on the one hand, and for adjustment of the boot position from "regular" to "goofy,"on the other hand; said detachable connection comprises at least two cylindrical pins secured to the gliding board and having near the top thereof a circular groove, said guide elements being provided, for mounting on said cylindrical pins, with an arcuate row of holes having diameters matching said cylindrical pins and centers equidistant from said fixing element, on one side, and with a slot-shaped recess, on the other side, the distance of said recess from said fixing element being constant, and clamping elements being insertable in said groove of said cylindrical pins for gripping said guide elements.

17. The adjustable length binding unit of claim 16, wherein said clamping elements have on one side a U-shaped slot insertable into said circular groove of one of said cylindrical pins, and on the side remote from said slot an opening fur receiving an eccentric means.

18. The adjustable length binding unit of claim 17, wherein said eccentric means comprises a common clamping yoke having a rod with a flat area on one side thereof wedgeable into said opening on said clamping element opposite said slots such that when said yoke is rotated said clamping elements are displaced outwardly from said base plate to a level where said clamping elements can be slid free of said grooves in said pins thereby freeing said guide elements for movement about said fixing element; said yoke having a clamping position wherein said pins tip said clamping elements downward opposite of said slots to clamp said flat area of said yoke against said support plates thereby holding said guide elements tightly to said gliding board, and an adjusting position wherein rotation of said yoke raises said clamping elements off of said flat area and onto the cylindrical portion of said rod such that said clamping elements can be withdrawn from grooves in said pins such that said base plate and guide elements are rotatable about said fixing element.

* * * * *